US009532916B2

(12) United States Patent
Tsui et al.

(10) Patent No.: US 9,532,916 B2
(45) Date of Patent: Jan. 3, 2017

(54) WEARABLE POWER ASSISTIVE DEVICE FOR HAND REHABILITATION

(71) Applicants: Rehab-Robotics Company Limited, Shatin, N.T., Hong Kong (HK); The Hong Kong Polytechnic University, Hong Kong (HK)

(72) Inventors: Michael Kam Fai Tsui, Hong Kong (HK); Kai Yu Tong, Hong Kong (HK)

(73) Assignees: REHAB-ROBOTICS COMPANY LIMITED, Hong Kong (HK); THE HONG KONG POLYTECHNIC UNIVERSITY, Hong Kong (HK)

( * ) Notice: Subject to any disclaimer, the term of this patent is extended or adjusted under 35 U.S.C. 154(b) by 852 days.

(21) Appl. No.: 13/851,955

(22) Filed: Mar. 28, 2013

(65) Prior Publication Data

US 2013/0261514 A1 Oct. 3, 2013

Related U.S. Application Data

(60) Provisional application No. 61/617,671, filed on Mar. 30, 2012.

(51) Int. Cl.
*A61H 1/02* (2006.01)

(52) U.S. Cl.
CPC ..... *A61H 1/0285* (2013.01); *A61H 1/0288* (2013.01); *A61H 2201/123* (2013.01); *A61H 2201/165* (2013.01); *A61H 2201/5007* (2013.01); *A61H 2230/605* (2013.01)

(58) Field of Classification Search
CPC ..... A61H 1/0285–1/0288; A61H 2201/123; A61H 2201/5007; A61H 2230/605; A63B 23/16; A61F 2/54; A61F 2/583; A61F 2/586; A61F 2002/587; A61F 5/0118
See application file for complete search history.

(56) References Cited

U.S. PATENT DOCUMENTS

| | | | | |
|---|---|---|---|---|
| 5,328,448 | A * | 7/1994 | Gray, Sr. | A61H 1/0288 482/44 |
| 5,547,464 | A * | 8/1996 | Luttrell | A61F 5/0111 482/111 |
| 8,574,178 | B2 | 11/2013 | Tong et al. | |
| 2006/0094989 | A1 * | 5/2006 | Scott | A61F 2/54 601/5 |
| 2007/0265140 | A1 * | 11/2007 | Kim | A61H 1/02 482/8 |
| 2008/0109084 | A1 * | 5/2008 | Maitland | A61F 2/586 623/21.15 |

(Continued)

*Primary Examiner* — Rachel Young

(57) ABSTRACT

A wearable power assistive device for hand rehabilitation includes a hand brace having an external platform and an internal platform connected to and spaced inwardly from the external platform. Five finger assemblies are adjustably mounted on and extending from the distal end of the external platform. Each finger assembly includes a proximal follower assembly for a metacarpophalangeal joint. Five motors are used to actuate the five finger assemblies respectively. Each motor is mounted in close proximity to the external platform and has one end connected to the external platform and another end coupled to its proximal follower assembly by a ball joint in order to facilitate transfer of force and minimize mechanical stress on the other parts of the device.

18 Claims, 17 Drawing Sheets

(56) References Cited

U.S. PATENT DOCUMENTS

| | | | | |
|---|---|---|---|---|
| 2008/0208093 | A1* | 8/2008 | Hassler | A61F 5/05866 602/21 |
| 2010/0057149 | A1* | 3/2010 | Fahey | A61H 11/00 607/3 |
| 2010/0305717 | A1* | 12/2010 | Tong | A61H 1/0285 623/64 |
| 2012/0059291 | A1* | 3/2012 | Nguyen | A61H 1/0288 601/40 |
| 2012/0160126 | A1* | 6/2012 | Rathbun | B61B 10/022 105/238.1 |

* cited by examiner 1
10
1
10
1
10
1
10
1
7
9
7
9
7
9

WEARABLE POWER ASSISTIVE DEVICE FOR HAND REHABILITATION

CROSS-REFERENCE TO RELATED APPLICATIONS

This application claims priority of U.S. Provisional Patent Application No. 61/617,671 filed on Mar. 30, 2012, the entire content of which is hereby incorporated by reference.

FIELD OF TECHNOLOGY

The present application relates to a wearable power assistive device for hand rehabilitation.

BACKGROUND

A wearable power assistive device for hand rehabilitation is a device having a plurality of motor-driven finger assemblies that is used to help a user to move his/her hands in hand rehabilitation trainings. Existing wearable power assistive devices for hand rehabilitation suffer from several limitations, namely, (1) the motors are aligning irregularly and would therefore easily lead to building up of mechanical stress and decreasing in durability; (2) insecure fixation of components; and (3) lack of ergonomic consideration.

Thus, there is a need to produce an improved wearable power assistive device for hand rehabilitation that is more durable, comfortable to wear, and ergonomically fit for the hands of a user.

The above description of the background is provided to aid in understanding a wearable power assistive device for hand rehabilitation, but is not admitted to describe or constitute pertinent prior art to the wearable power assistive device for hand rehabilitation disclosed in the present application, or consider any cited documents as material to the patentability of the claims of the present application.

SUMMARY

According to one aspect, there is provided a wearable power assistive device for hand rehabilitation including a palm brace having an external platform and an internal platform connected to and spaced inwardly from the external platform. The external platform extends in a longitudinal direction between proximal and distal ends thereof. A plurality of finger assemblies may be adjustably mounted on and extending outwardly from the distal end of the external platform generally in a longitudinal direction. Each finger assembly may include a proximal follower assembly for a metacarpophalangeal joint. A plurality of motors may be used to actuate the plurality of finger assemblies respectively. Each motor may have a proximal end connected to the proximal end of the external platform through an individual rear support, and a distal end coupled to its corresponding proximal follower assembly by a ball joint. According to one embodiment, the device has five motors for actuating five finger assemblies respectively.

Each finger assembly my have a proximal end portion having at least one threaded opening and two opposite lateral sides, each being formed with a plurality of longitudinally spaced recesses selectively engageable with a plurality of longitudinally spaced protrusions formed on an inner surface of the external platform. At least one set screw is adapted to pass through at least one longitudinally elongated opening formed on the external platform and is releasably driven into the at least one threaded opening of the proximal end portion abutting against the inner surface of the external platform, thereby allowing each finger assembly to be adjustable in the longitudinal direction to match different finger lengths.

The external platform may have an inturned thumb platform, and one of the finger assemblies for the thumb is adjustably connected to the inturned thumb platform. The device may further include an engagement member detachably mounted on an inner surface of the inturned palm platform. The engagement member has two opposite sides, each having a plurality of longitudinally spaced projections selectively engageable with the plurality of longitudinally spaced recesses formed on the proximal end portion of the finger assembly for the thumb. The inturned thumb platform may be formed with a plurality of laterally spaced and longitudinally elongated openings. At least one screw may be adapted to pass through a selected one of the laterally spaced and longitudinally elongated openings and is releasably driven into the at least one threaded opening of the finger assembly for the thumb, thereby allowing the finger assembly for the thumb to be adjustable in the longitudinal direction to match different thumb lengths and adjustable to different lateral positions to match different thumb positions.

In one embodiment, the inturned palm platform may have three laterally spaced and longitudinally elongated openings, and the finger assembly for the thumb is adjustable to three different lateral positions.

The device may further include a side fixation bracket adjustably connected to a little finger side of the external platform at different lateral positions to fit different palm sizes. The side fixation bracket may have first and second portions disposed perpendicular to each other. The first portion may have a plurality of transversely spaced openings selectively engageable therein with a plurality of transversely spaced annular protrusions, each having a central threaded opening, formed on an inner surface of the external platform. At least one set screw may be adapted to pass through a washer and is releasably driven into one of the central threaded openings, thereby fastening the side fixation bracket to the external platform.

The internal platform can be provided with at least one opening with a notch defining a catch for releasably holding the internal platform between the washer and the annular protrusion on the external platform.

The internal platform has two lateral sides, one lateral side being provided with two indentations and the other lateral side being provided with two other indentations. Two sets of screw and nut can be adapted to be driven through two openings formed on the inturned thumb platform and into the two indentations on the one lateral side of the internal platform respectively, and another two sets of screw and nut are adapted to be driven through two openings formed on the second portion of the side fixation bracket and into the two other indentations on the other lateral side of the internal platform respectively.

The motors can be disposed substantially parallel and in close proximity to the external platform, thereby minimizing the mechanical stress exerted transversely on the device by the motors. In one embodiment, the motor is a linear actuator.

The device may further include a forearm support having a front end portion and a rear end portion, a mounting insert being detachably mounted on a top side of the front end portion, whereby the palm brace and finger assemblies are mountable on the mounting insert.

The device may have two interchangeable mounting inserts with two differently oriented mounting portions for mounting thereon the palm brace and finger assemblies for the left and right hands respectively.

The forearm support may have an upper slanted surface inclining downwardly from the top side to the rear end portion of the forearm support at an angle of about 25 degrees with respect to a horizontal surface on which the forearm support is rested. The device may further include a built-in optical device disposed inside the forearm support for positional feedback. The external platform of the palm brace can be mounted on the forearm support at an angle of about 10 degrees with respect to a central longitudinal axis of the forearm support.

The device may further include two electrodes adhered on a flexor digitorum muscle and an extensor digitorum muscle respectively for detecting electromyography signals from a user. A reference electrode can be mounted over a bony prominence of an elbow for providing a common reference to the inputs of the two electrodes. The reference electrode can be incorporated into an adjustable strap to facilitate the fixation of the reference electrode on the elbow.

The device may further include a programmable control unit installed in the forearm support and controlled by a computer platform. The computer platform can be selected from the group consisting of Apple IOS, Android, Microsoft Windows, Mac OSX, Linux and Unix.

Although the wearable power assistive device for hand rehabilitation disclosed in the present application is shown and described with respect to certain embodiments, it is obvious that equivalents and modifications will occur to others skilled in the art upon the reading and understanding of the specification. The present application includes all such equivalents and modifications, and is limited only by the scope of the claims.

BRIEF DESCRIPTION OF THE DRAWINGS

Specific embodiments of the wearable power assistive device for hand rehabilitation disclosed in the present application will now be described by way of example with reference to the accompanying drawings wherein.

DETAILED DESCRIPTION

Figure 1:
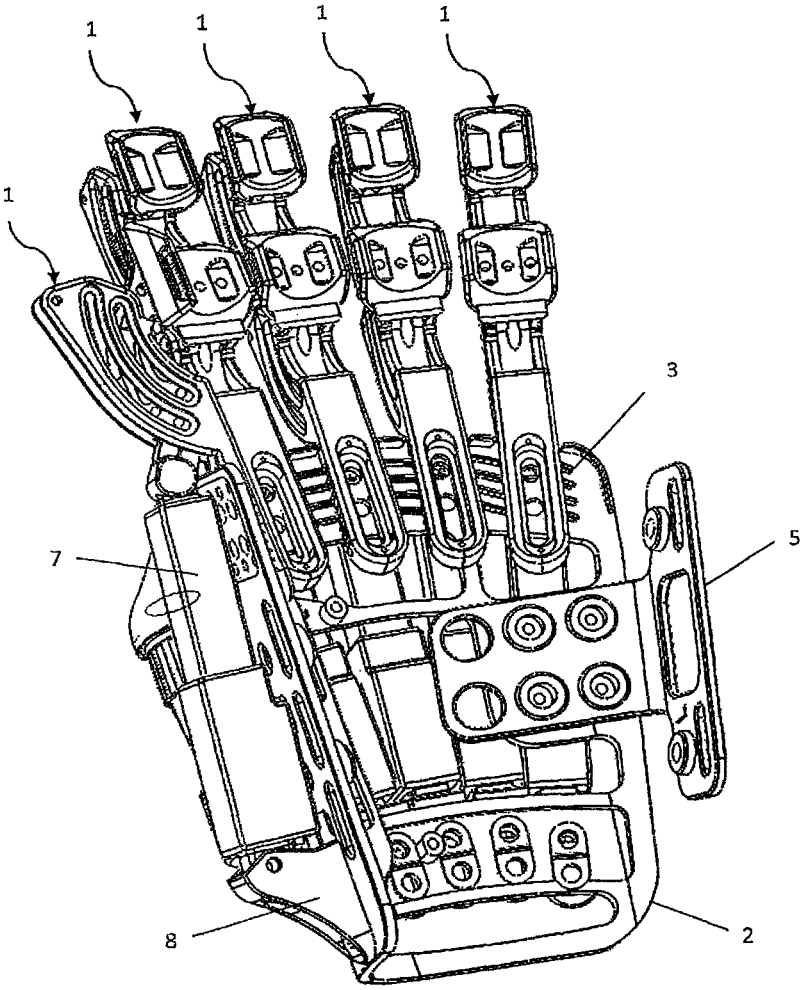
FIG. 1 is a bottom perspective view of a palm brace of a wearable power assistive device for hand rehabilitation according to an embodiment of the present application, showing five finger assemblies mounted on an external platform.
Figure 2:
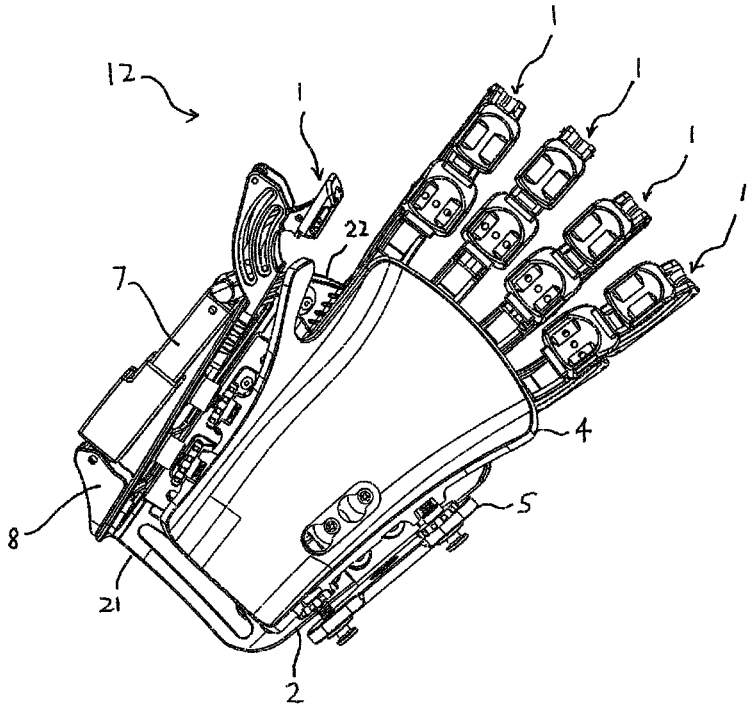
FIG. 2 is a bottom perspective view of the device with an internal platform mounted by side screws underneath the external platform according to an embodiment of the present application.
Figure 3:
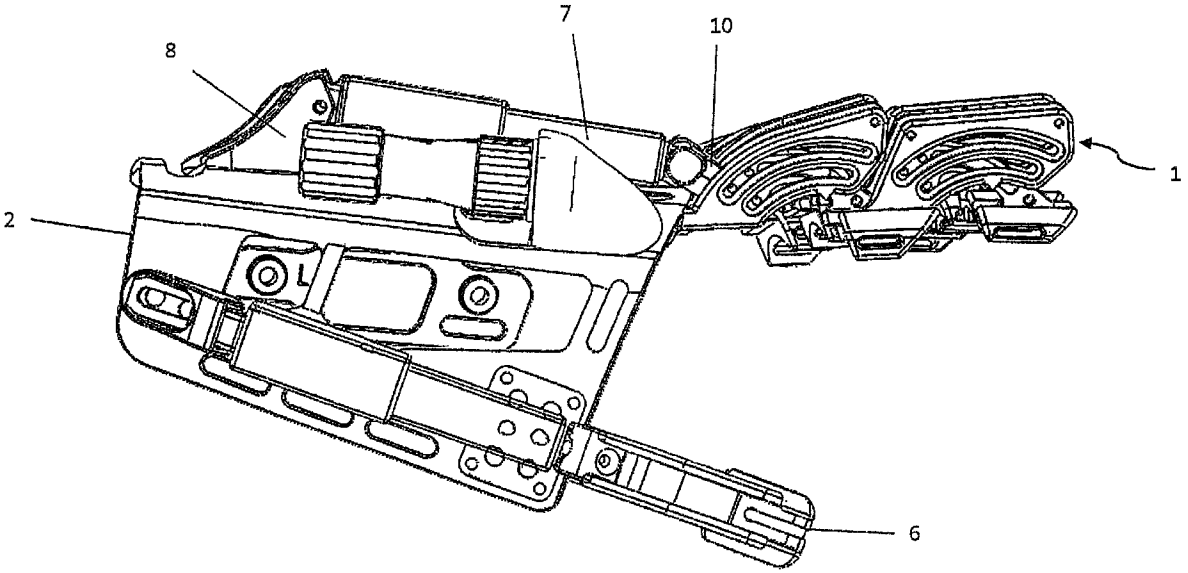
FIG. 3 is a side view of the device showing the finger assembly for thumb according to an embodiment of the present application.
Figure 4:
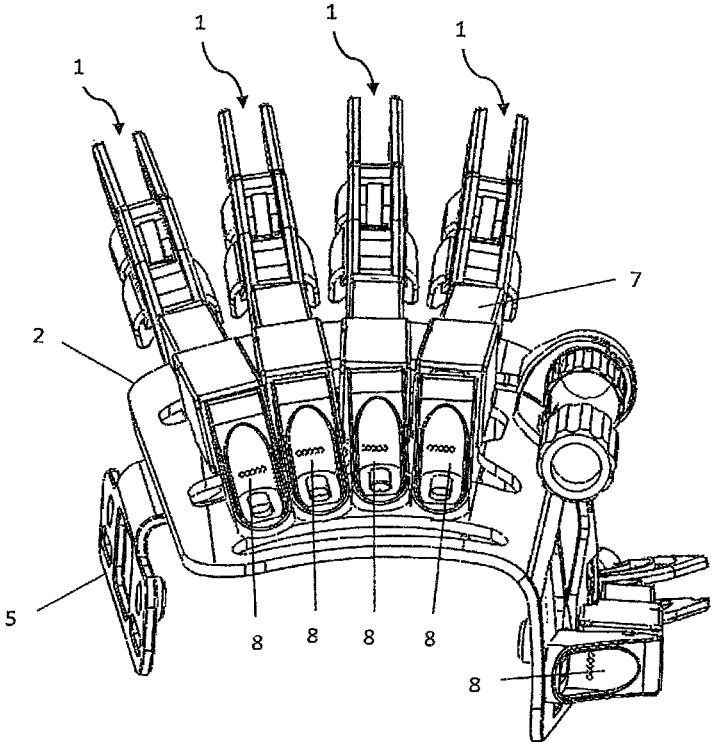
FIG. 4 is a rear perspective view of the device showing each motor being coupled to an individual rear support according to an embodiment of the present application.

Reference will now be made in detail to a preferred embodiment of the wearable power assistive device for hand rehabilitation disclosed in the present application, examples of which are also provided in the following description. Exemplary embodiments of the wearable power assistive device for hand rehabilitation disclosed in the present application are described in detail, although it will be apparent to those skilled in the relevant art that some features that are not particularly important to an understanding of the wearable power assistive device for hand rehabilitation may not be shown for the sake of clarity.

Furthermore, it should be understood that the wearable power assistive device for hand rehabilitation disclosed in the present application is not limited to the precise embodiments described below and that various changes and modifications thereof may be effected by one skilled in the art without departing from the spirit or scope of the appended claims. For example, elements and/or features of different illustrative embodiments may be combined with each other and/or substituted for each other within the scope of this disclosure and appended claims.

In addition, improvements and modifications which may become apparent to persons of ordinary skill in the art after reading this disclosure, the drawings, and the appended claims are deemed within the spirit and scope of the appended claims.

It should be noted that throughout the specification and claims herein, when one element is said to be "coupled" or "connected" to another, this does not necessarily mean that one element is fastened, secured, or otherwise attached to another element. Instead, the term "coupled" or "connected" means that one element is either connected directly or indirectly to another element, or is in mechanical or electrical communication with another element.

FIGS. 1 to 23 are different views of a wearable power assistive device 12 for hand rehabilitation according to an embodiment of the present application. The device 12 can be used for hand rehabilitation training of patients with upper limb paralysis due to stroke. The device 12 can be driven by electromyography (EMG) signals of the affected limb of the patient. The EMG signals can indicate the intention of movement of the limb of the patient. This may enable the patient to perform self-intended movement assisted by the device 12. The device 12 can be used as a wearable exoskeleton, which may be worn on the dorsal side of the left or right hand of the patient.

As shown in FIGS. 1 to 4, the device 12 may include a palm brace having an external platform 2 and an internal platform 4. The internal platform 4 may be connected to and spaced inwardly from the external platform 2. The external platform 2 may extend in a longitudinal direction between a proximal end 21 and a distal end 22 of the external platform 2.

The device 12 may include a plurality of finger assemblies 1. According to the illustrated embodiment, the device 12 may include five finger assemblies 1 adjustably mounted on and extending outwardly from the distal end 22 of the external platform 2 in a generally longitudinal direction. Each finger assembly 1 may include a proximal follower assembly 10 for a metacarpophalangeal joint. Detailed structures of the finger assemblies 1 are disclosed in U.S. Patent Application Publication No. US 2010/0305717 A, the entire content of which is hereby incorporated by reference.

Figure 5:
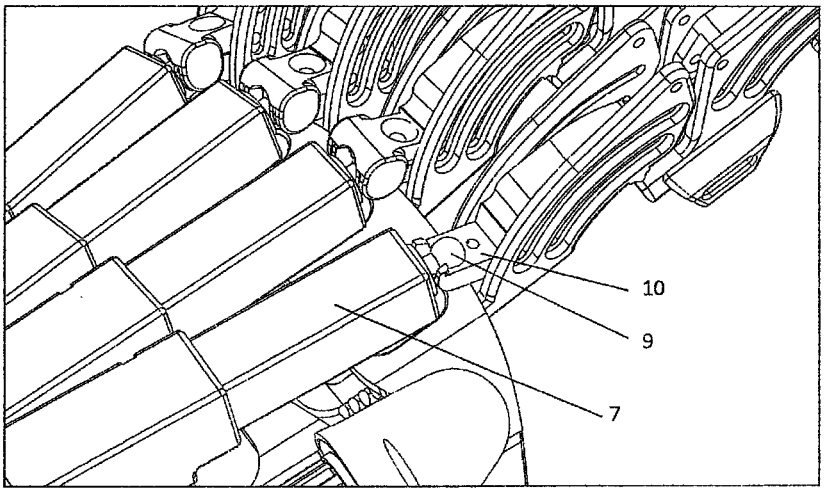
FIG. 5 is a cut-away perspective view of the device showing the ball joints for connecting the motors and their corresponding proximal follower assemblies according to an embodiment of the present application.

The device 12 may include five motors 7 for actuating the five finger assemblies 1 respectively. Each motor 7 may have a proximal end connected to the proximal end 21 of the external platform 2 through an individual rear support 8, and a distal end coupled to its corresponding proximal follower assembly 10 by a ball joint 9, as best illustrated in FIG. 5. The use of ball joints 9 can minimize the mechanical stress exerted by the motors 7 during operation.

A spherical bearing stud portion of each ball joint 9 can be formed integrally at the distal end of each motor 7, whereas a socket portion of each ball joint 9 can be incorporated at an end of proximal follower assembly 10. The ball joints 9 allow smooth movement in all directions, thereby minimizing the mechanical stress exerted by the motors 7 in all directions other than the direction in which the proximal follower assembly 10 is driven during operation.

The motors 7 may be in the form of any suitable kind of motor that can convert electrical energy into mechanical energy for moving the finger assemblies 1. For example, the motors 7 may be in the form of linear actuators.

Figure 12:
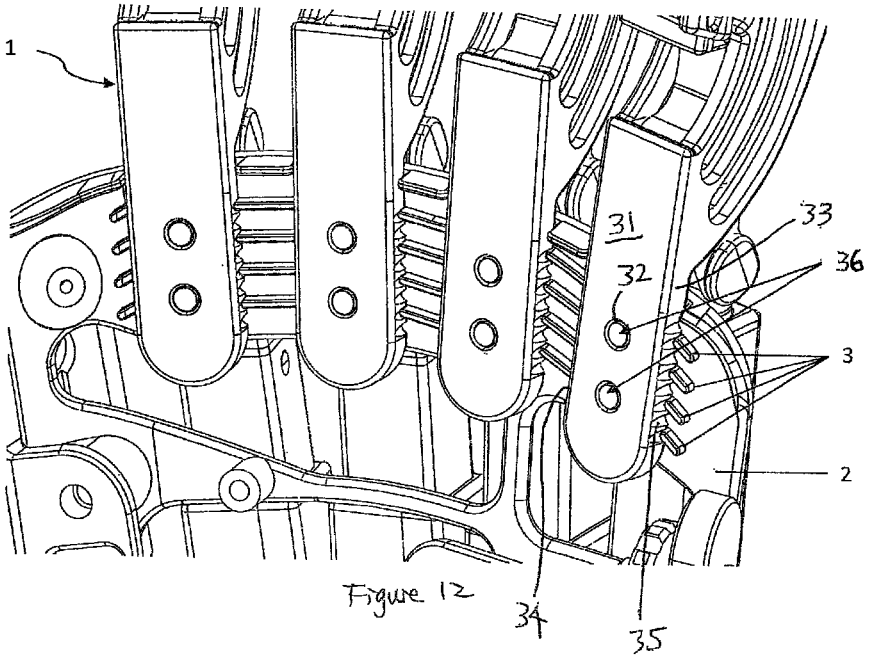
FIG. 12 is an enlarged view of the mounting of the finger assemblies on the external platform of the device according to an embodiment of the present application.
Figure 13:
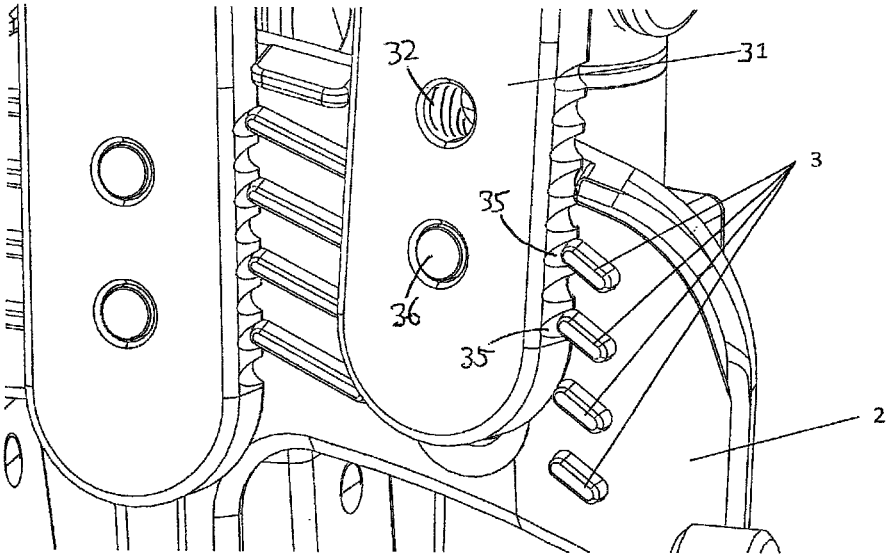
FIG. 13 is an enlarged view showing the adjustment of a finger assembly on the external platform of the device according to an embodiment of the present application.

As depicted in FIGS. 12 and 13, each finger assembly 1 may have a proximal end portion 31 having two threaded openings 32 and two opposite lateral sides 33, 34. Each lateral side 33, 34 can be formed with a plurality of longitudinally spaced recesses 35. The plurality of longitudinally spaced recesses 35 can be selectively engageable with a plurality of longitudinally spaced protrusions 3 formed on an inner surface of the external platform 2. Two set screws 36 can be adapted to pass through two longitudinally elongated openings formed on the external platform 2 and can be releasably driven into the two threaded openings 32 of each proximal end portion 31 abutting against the inner surface of the external platform 2, thereby allowing each finger assembly 1 to be adjustable in the longitudinal direction to match different finger lengths.

According to the illustrated embodiment, there are eight recesses 35 formed along one lateral side of the proximal end portion 31, and four protrusions 3 formed on the inner surface of the external platform 2. The plurality of protrusions 3 may be in the form of a plurality of transversely extending bars.

Although it has been shown and described that two threaded openings 32 and two set screws 36 are used to fasten each finger assembly 1 to the external platform 2, it is understood that one threaded opening 32 and one set screw 36 may be sufficient.

Furthermore, although it has been shown and described that the finger assemblies 1 are formed with a plurality of longitudinally spaced recesses 35 selectively engageable with a plurality of longitudinally spaced protrusions 3 formed on the external platform 2, it is appreciated that many other modifications may be adopted. For example, the finger assemblies 1 may be formed with a plurality of longitudinally spaced protrusions for selective engagement with a plurality of longitudinally spaced recesses formed on the external platform 2.

As illustrated in FIGS. 18-21, the external platform 2 may have an inturned thumb platform 23. The inturned thumb platform 23 may be formed separately or integrally with the external platform 2. One of the five finger assemblies for the thumb 6 can be adjustably connected to the inturned thumb platform 23 of the external platform 2 at different positions to match different thumb lengths, different web sizes between a thumb and an index finger and thumb positions.

According to the illustrated embodiment, the inturned thumb platform 23 may be formed with three pairs of laterally spaced and longitudinally elongated openings 24 selectively register able with the two threaded openings 61 formed on the proximal end portion of the finger assembly for the thumb 6. Two screws may be adapted to pass through two longitudinally elongated openings 24 formed on the inturned thumb platform 23 and can be releasably driven into the two threaded openings 61 of the finger assembly for the thumb 6, thereby allowing the finger assembly for the thumb 6 to be adjustable in the longitudinal direction to match different thumb lengths.

The device 12 may further include an engagement member 25 having two openings 27 registered with two openings 28 formed on the inturned thumb platform 23. Two screws can be adapted to drive through the registered openings 27, 28 and fasten the engagement member 25 on an inner surface of the inturned palm platform 23. The engagement member 25 may have two opposite sides each having a plurality of longitudinally spaced projections 26 selectively engageable with the plurality of longitudinally spaced recesses 62 formed on the proximal end portion of the finger assembly for the thumb 6. According to the illustrated embodiment, there are four projections 26 formed along each side of the engagement member 25.

Figure 19:
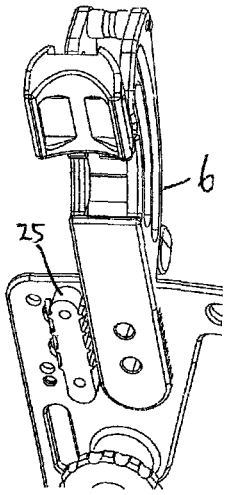
FIG. 19 is a bottom perspective view of the finger assembly for the thumb being mounted on the inturned thumb platform at a first position according to an embodiment of the present application.
Figure 20:
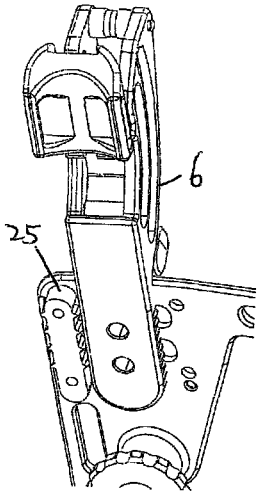
FIG. 20 is a bottom perspective view of the finger assembly for the thumb being mounted on the inturned thumb platform at a second position according to an embodiment of the present application.
Figure 21:
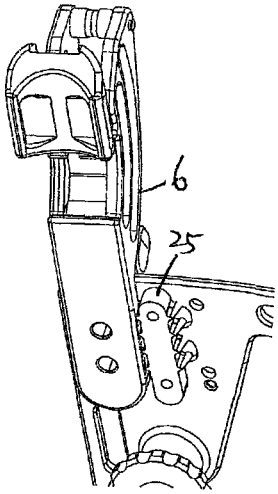
FIG. 21 is a bottom perspective view of the finger assembly for the thumb being mounted on the inturned thumb platform at a third position according to an embodiment of the present application.

Since the inturned palm platform 23 has three pairs of laterally spaced and longitudinally elongated openings 24, the finger assembly for the thumb 6 can be adjustable to three different positions, as shown in FIGS. 19-21.

Although it has been shown and described that the inturned thumb platform 23 is formed with three pairs of laterally spaced and longitudinally elongated openings 24 selectively register able with the two threaded openings 61 formed on the proximal end portion of the finger assembly for the thumb 6, it is contemplated that the inturned thumb platform 23 may have only three laterally spaced and longitudinally elongated openings 24 selectively register able with the one threaded opening 61 formed on the proximal end portion of the finger assembly for the thumb 6.

Figure 15:
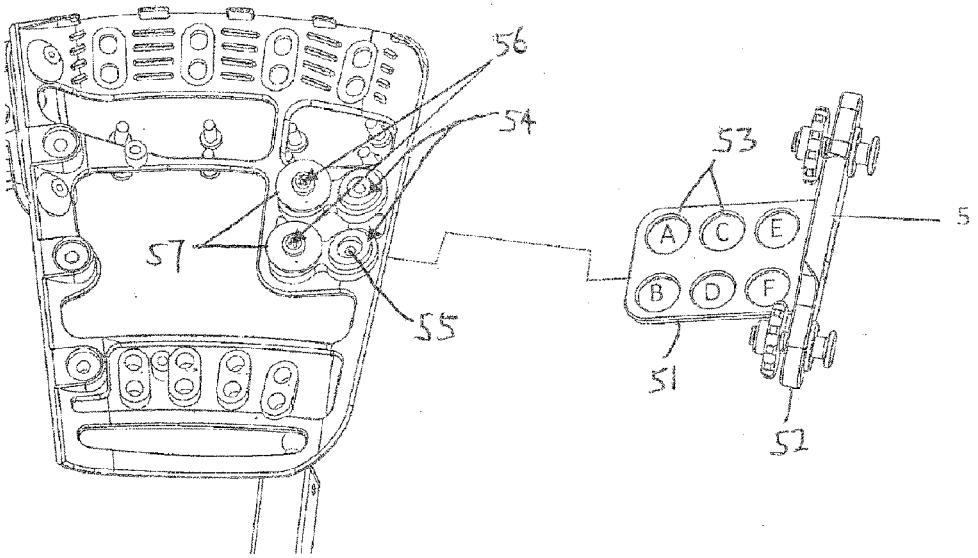
FIG. 15 is an exploded view of the external platform and a side fixation bracket of the device according to an embodiment of the present application.
Figure 16:
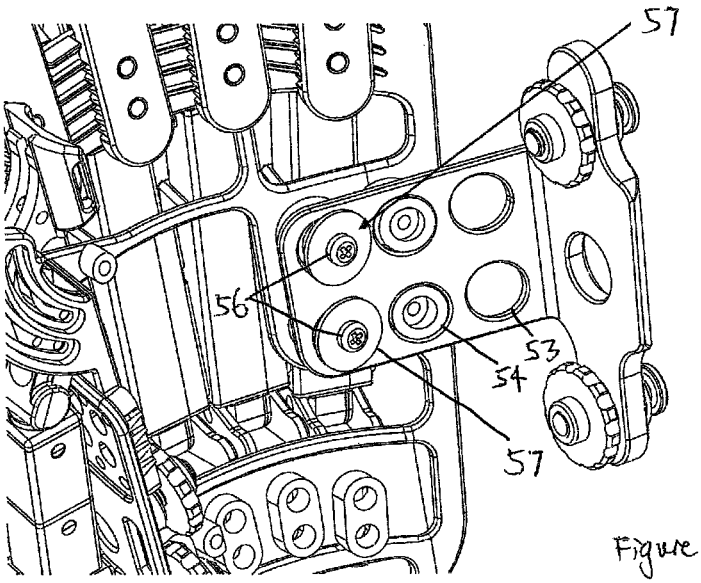
FIG. 16 is a perspective view showing the mounting of the side fixation bracket on the external platform at a first position according to an embodiment of the present application.
Figure 17:
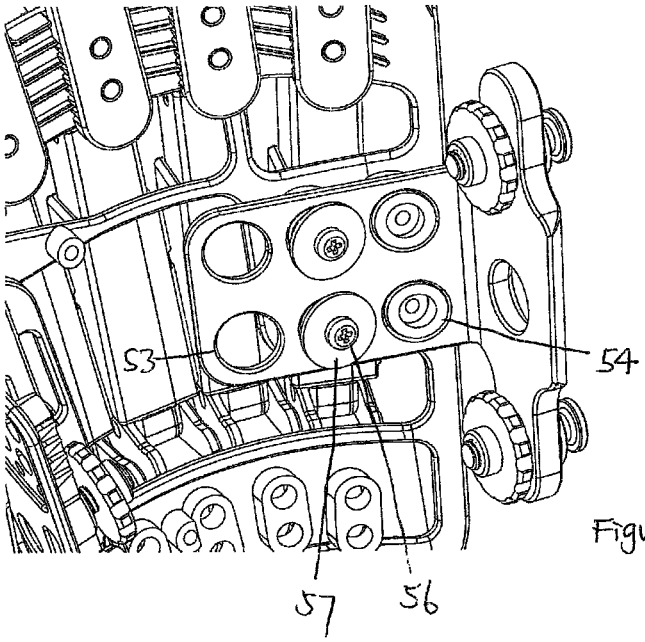
FIG. 17 is a perspective view showing the mounting of the side fixation bracket on the external platform at a second position according to an embodiment of the present application.
Figure 18:
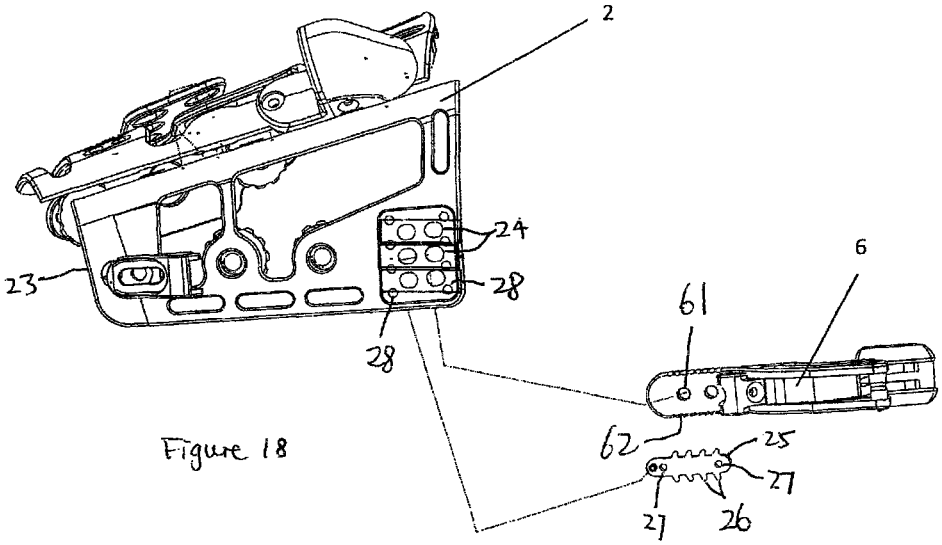
FIG. 18 is an exploded view of an inturned thumb platform of the external platform, the finger assembly for the thumb, and an engagement member of the device according to an embodiment of the present application.

As depicted in FIGS. 15-17, the device 12 may further include a side fixation or bracket 5 adjustably connected to a little finger side of the external platform 2 at different lateral positions to match different palm sizes.

The side fixation bracket 5 may have first and second portions 51, 52 disposed perpendicular to each other. The first portion 51 may have three pairs of transversely spaced openings 53 selectively engageable therein with two pairs of transversely spaced annular protrusions 54, each having a central threaded opening 55, formed on an inner surface of the external platform 2. Two set screws 56 may be adapted to be driven through two washers 57 and into two central threaded openings 55 of two annular protrusions 54 engaged with two openings 53 of the first portion 51 respectively, thereby fastening the side fixation bracket 5 to the external platform 2. FIGS. 16 and 17 show the mounting of the side fixation bracket 5 on the external platform 2 at two different positions.

Figure 14:
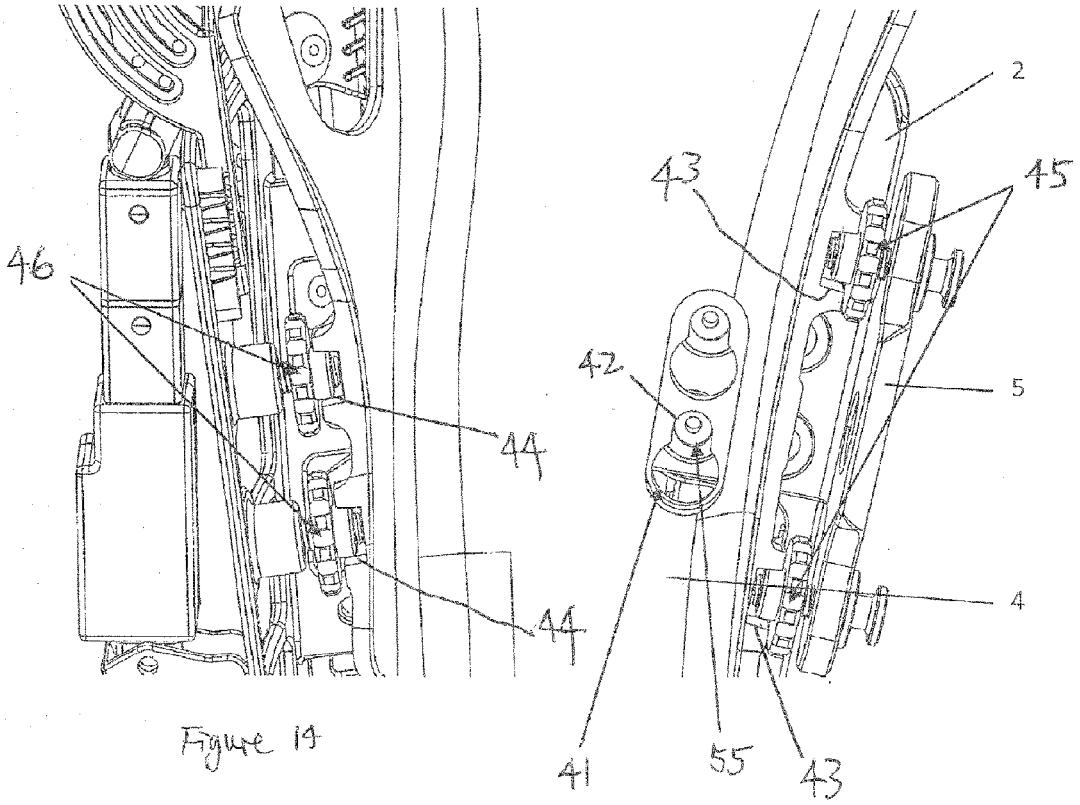
FIG. 14 is a cut-away bottom view showing the internal platform being mounted on the external platform.

Although it has been shown and described that the first portion 51 has three pairs of transversely spaced openings 53 selectively engageable therein with two pairs of transversely spaced annular protrusions 54 formed on an inner surface of the external platform 2, it is understood that the first portion 51 may have only three transversely spaced openings 53 selectively engageable therein with two transversely spaced annular protrusions 54 formed on the external platform 2, As illustrated in FIG. 14, the internal platform 4 may be provided with two openings 41 with two notches 42 defining two hooks or catches for releasably holding the internal platform 4 between two washers 57 and two annular protrusions 54 respectively, thereby connecting the internal platform 4 to the external platform 2.

The internal platform 4 may have two lateral sides. One lateral side may be provided with two indentations 44 and the other lateral side may be provided with two other indentations 43. Two sets of screw and nut 46 can be driven into two openings formed on the inturned thumb platform 23 and into the two indentations 44 on the one lateral side of the internal platform 4 respectively, and another two sets of screw and nut 45 can be driven into two openings formed on the second portion 52 of the side fixation bracket 5 and into the two other indentations 43 on the other lateral side of the internal platform 4 respectively. The internal platform 4 can be used for placement of the palm of a user. The internal platform 4 may be of different sizes to accommodate different palm sizes.

Figure 22:
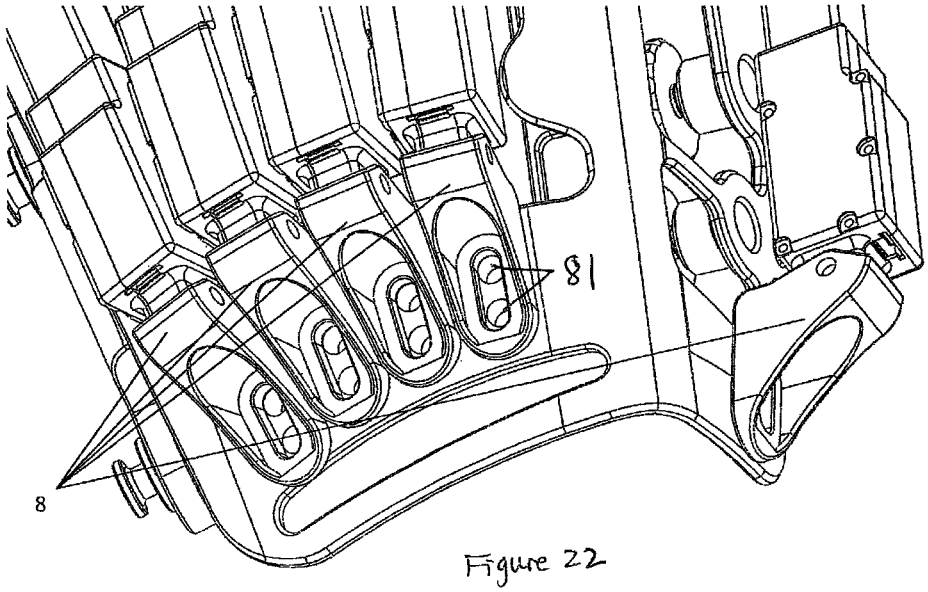
FIG. 22 is an enlarged perspective view showing the mounting of the five motors to five individual rear supports of the device according to an embodiment of the present application.
Figure 23:
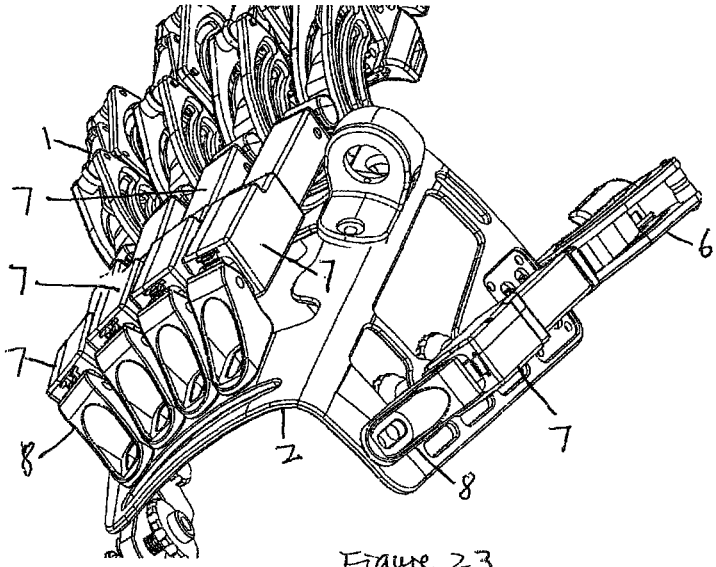
FIG. 23 is a rear perspective view of the device with finger assemblies, motors and rear supports arranged in a regular configuration and generally in a longitudinal direction according to an embodiment of the present application.

As shown in FIGS. 22 and 23, the five motors 7 can be disposed substantially parallel and in close proximity to the external platform 2, thereby minimizing the mechanical stress on the other parts of the external platform 2.

Figure 24:
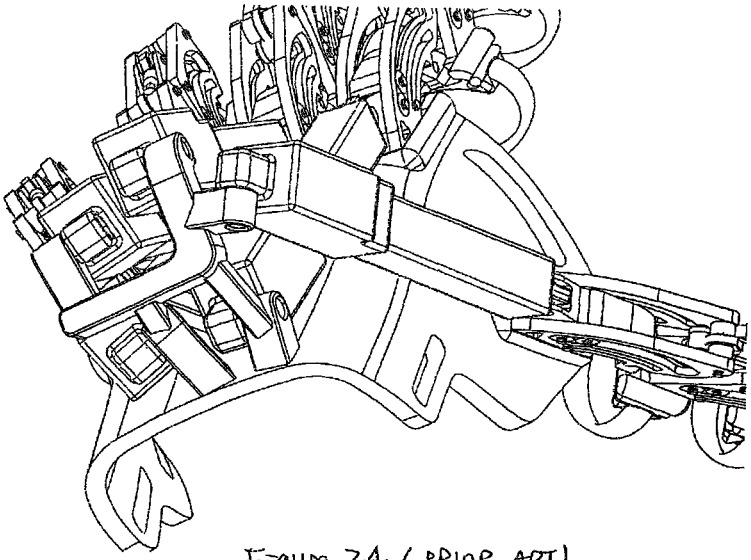
Figure 24 (PRIOR ART)
FIG. 24 is a rear perspective view of a device of the prior art with finger assemblies, motors and rear supports arranged in an irregular configuration.

One end of the individual rear support 8 may be fixed onto the external platform 2 by two screws through two screw holes 81, while the other end may be connected to the motor 7 via a hinge joint. The five individual rear supports 8 can facilitate proper alignment of the five motors 7. It can be seen that the five motors 7 and the five finger assemblies 1 are aligned in a regular configuration; whereas those in prior art devices are aligned irregularly, as indicated in FIG. 24.

Figure 7:
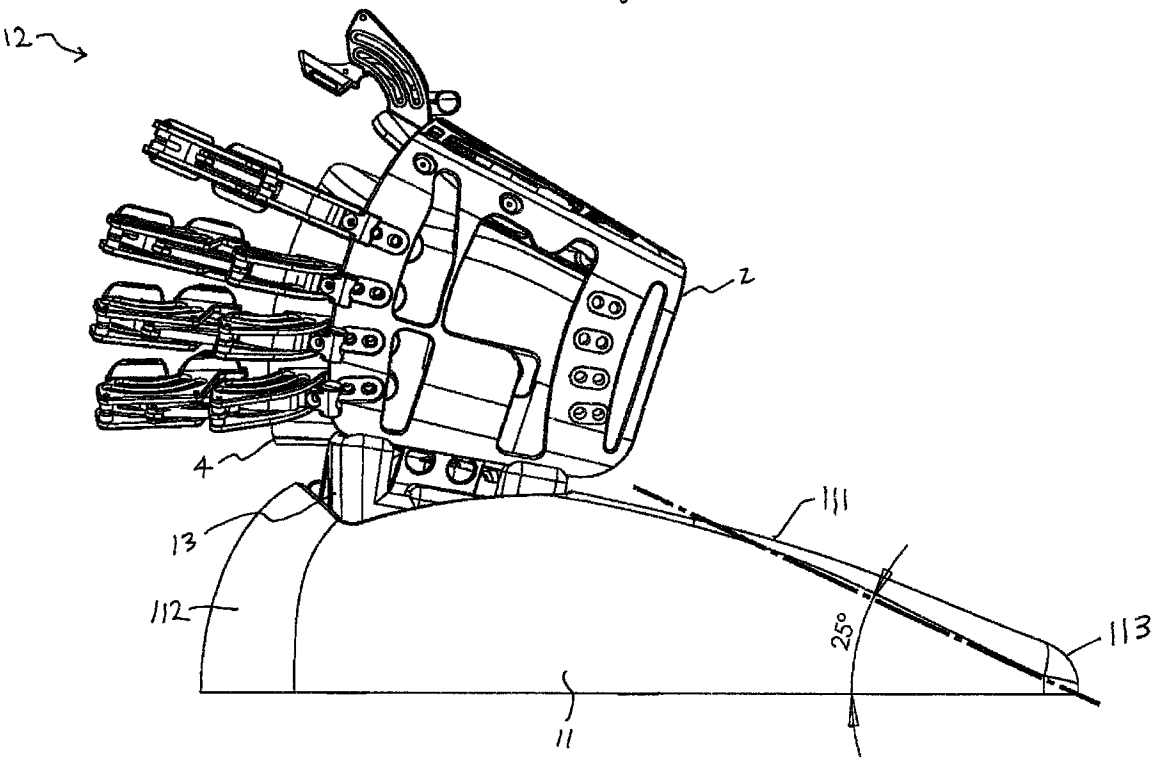
FIG. 7 is a side view of a forearm support with the device mounted thereon according to an embodiment of the present application.
Figure 8:
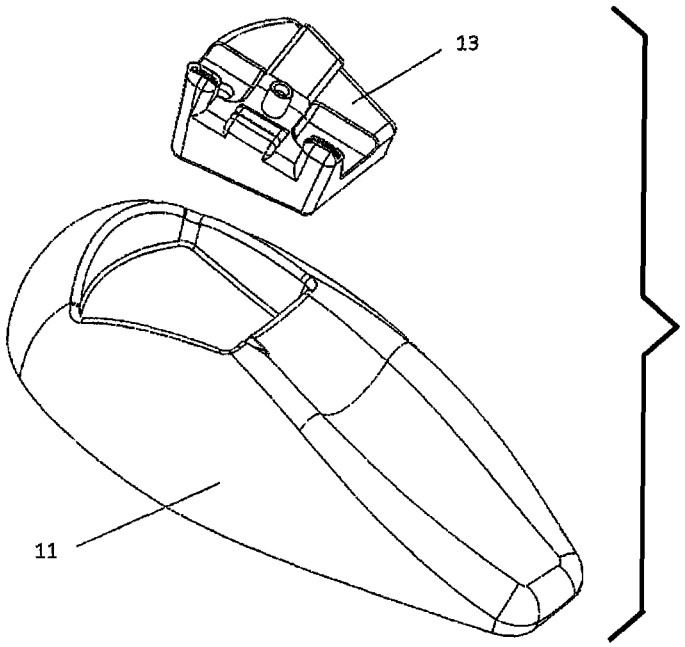
FIG. 8 is an exploded view of the forearm support showing a top concave surface for forearm placement according to an embodiment of the present application.
Figure 9:
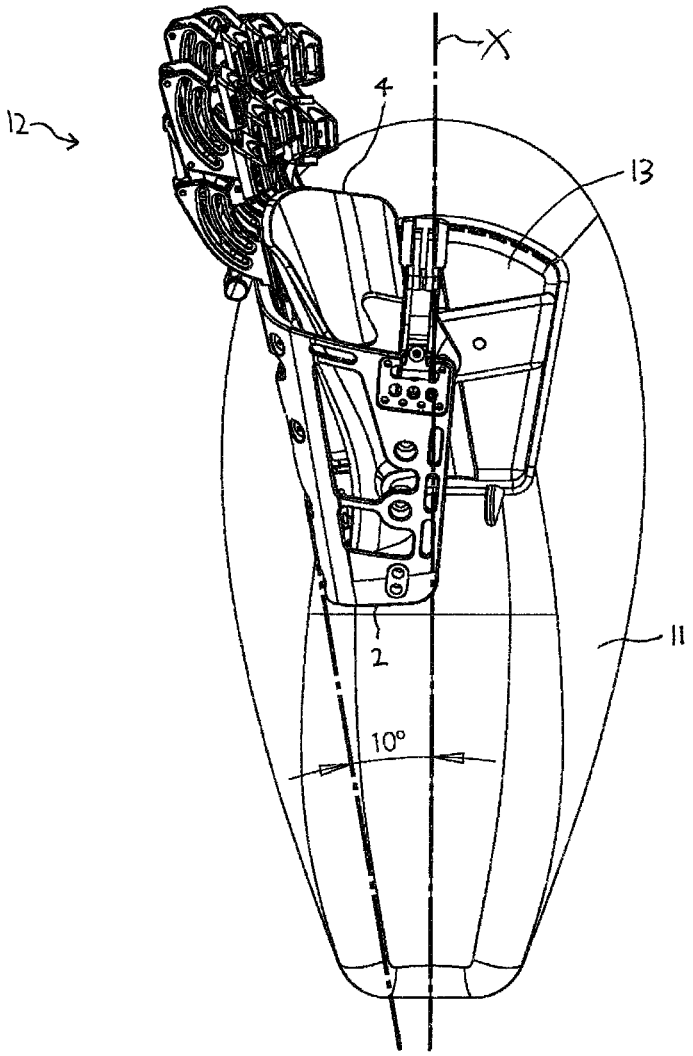
FIG. 9 is a top view of the forearm support with the device mounted thereon.
Figure 10:
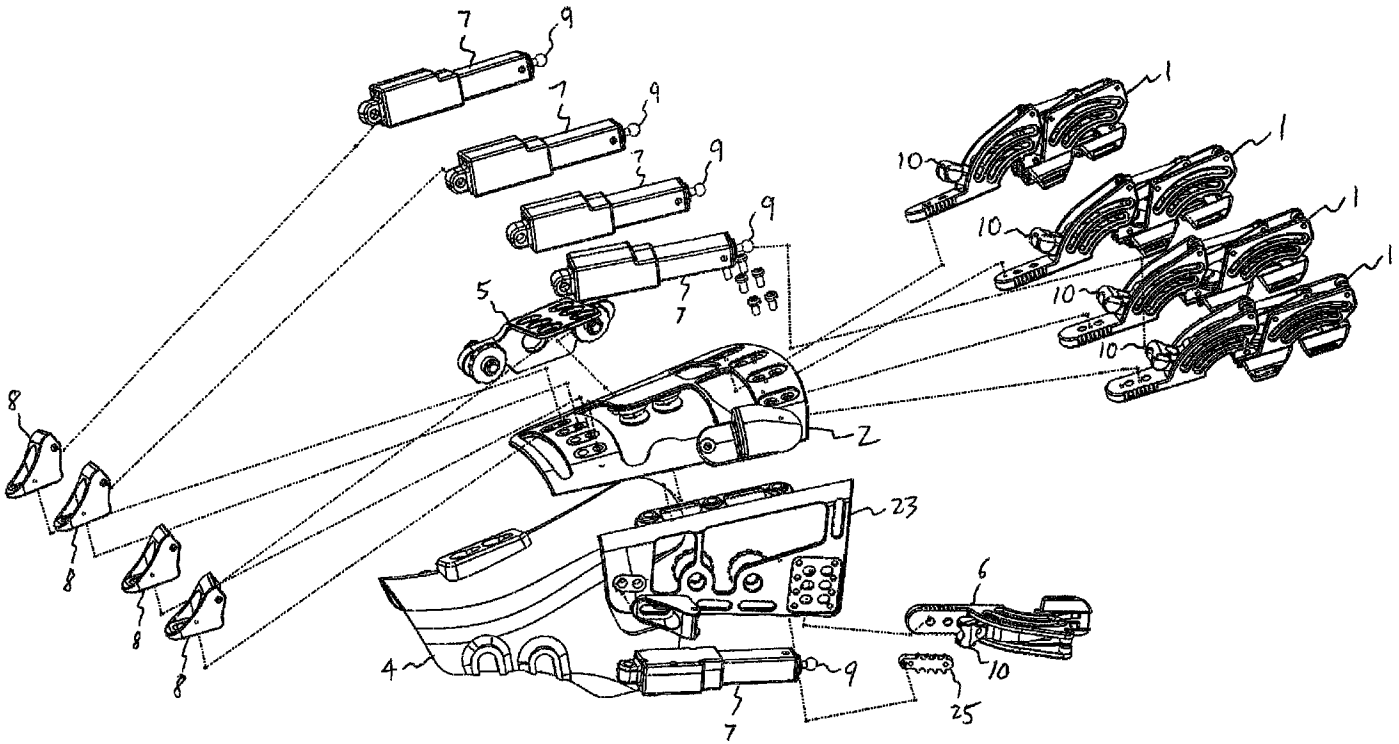
FIG. 10 is an exploded view of the device according to an embodiment of the present application.
Figure 11:
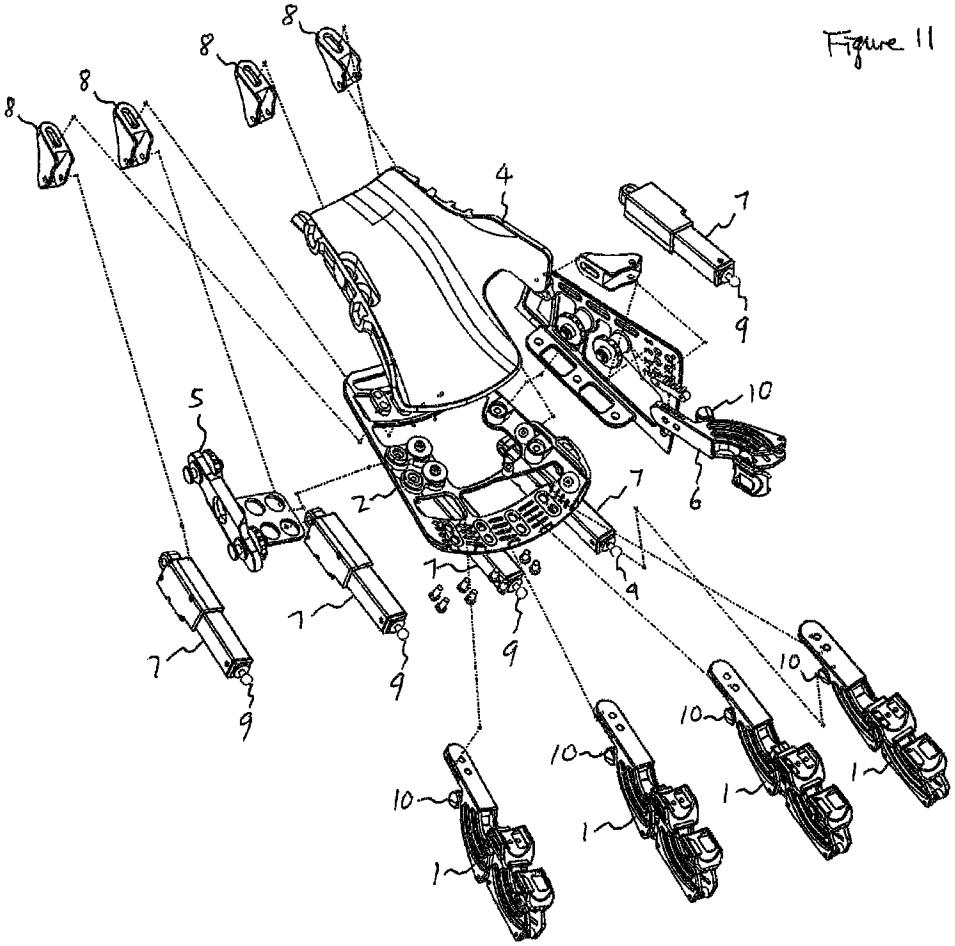
FIG. 11 is another exploded view of the device according to an embodiment of the present application.

As shown in FIGS. 7, 8 and 9, the device 12 may further include a forearm support 11 for supporting the device 12 during hand rehabilitation training to minimize the load exerted by the weight of the device 12 on the user's hand. The forearm support 11 may have a streamline design. The forearm support 11 may have a front end portion 112 and a rear end portion 113, a mounting insert 13 being detachably mounted on a top side of the front end portion 112, whereby the device 12 having the palm brace and finger assemblies can be mountable on the mounting insert 13.

The device 12 may come with two interchangeable mounting inserts 13 with two differently oriented mounting portions for mounting thereon palm braces and finger assemblies for the left and right hands respectively.

The forearm support 11 may have an upper slanted surface 111 inclining downwardly from the top side to the rear end portion 113 of the forearm support 11. The upper slanted surface 111 may incline at an angle of about 25 degrees with respect to a horizontal surface on which the forearm support 11 is rested. The upper slanted surface 111 may be concave in shape.

The device 12 may further include a built-in optical device disposed inside the forearm support 11 for positional feedback. The optical device may be in the form of a computer mouse or a platter.

The external platform 2 of the palm brace may be mounted on the forearm support 11 at an angle of about 10 degrees with respect to a central longitudinal axis X of the forearm support 11. This allows the hand of a user to be placed in a natural position with minimal stress to the wrist joint when wearing the device.

Figure 6:
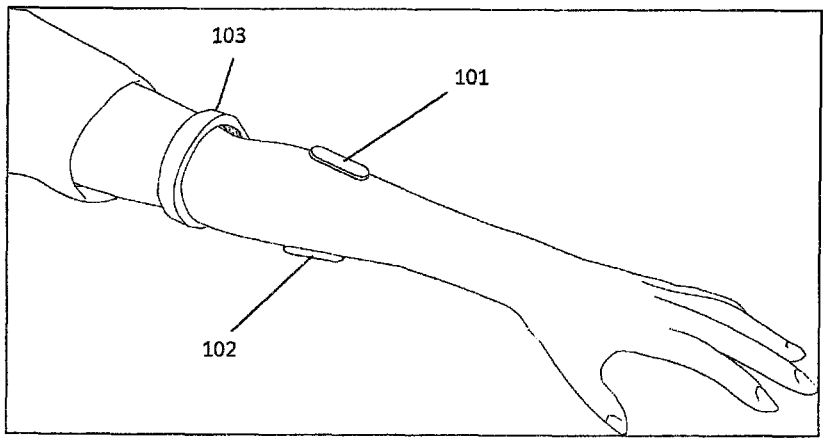
FIG. 6 is an illustrative diagram of a hand showing the placement of electrodes at flexor digitorum (FD) muscle and extensor digitorum (ED) muscle for detecting EMG signals according to an embodiment of the present application.

As shown in FIG. 6, the device 12 may further include two electrodes 101, 102 adhered on a flexor digitorum muscle and an extensor digitorum muscle respectively for detecting electromyography signals from a user. Each electrode 101, 102 may be incorporated into a sensor.

A reference electrode may be mounted over a bony prominence of an elbow for providing a common reference to the inputs of the two electrodes 101, 102. The reference electrode may be incorporated into an adjustable strap 103 to facilitate the fixation of the reference electrode on the elbow.

The device 12 may be a part of a hand rehabilitation system connected to a programmable control unit installed in the forearm support 11 and controlled by a computer platform. The computer platform may be selected from the group consisting of Apple IOS, Android, Microsoft Windows, Mac OSX, Linux and Unix.

While the wearable power assistive device for hand rehabilitation disclosed in the present application has been shown and described with particular references to a number of preferred embodiments thereof, it should be noted that various other changes or modifications may be made without departing from the scope of the appending claims.

What is claimed is:

1. A wearable power assistive device for hand rehabilitation comprising:

(a) a palm brace having an external platform and an internal platform connected to and spaced inwardly from the external platform, the external platform extending in a longitudinal direction between proximal and distal ends thereof;

(b) a plurality of finger assemblies adjustably mounted on and extending outwardly from the distal end of the external platform generally in a longitudinal direction, each finger assembly comprising a proximal follower assembly for a metacarpophalangeal joint; and (c) a plurality of motors for actuating the plurality of finger assemblies respectively, each motor having a proximal end connected to the proximal end of the external platform through an individual rear support, and a distal end of each motor coupled to its corresponding proximal follower assembly by a ball joint;

wherein the external platform has an inturned thumb platform, and one of the finger assemblies for the thumb is adjustably connected to the inturned thumb platform;

the device further comprises an engagement member detachably mounted on an inner surface of the inturned thumb platform, the engagement member having two opposite sides, each having a plurality of longitudinally spaced projections selectively engageable with the plurality of longitudinally spaced recesses formed on the proximal end portion of the finger assembly for the thumb, wherein the inturned thumb platform is formed with a plurality of laterally spaced and longitudinally elongated openings, and wherein at least one screw is adapted to pass through a selected one of the laterally spaced and longitudinally elongated openings and is releasably driven into the at least one threaded opening of the finger assembly for the thumb, thereby allowing the finger assembly for the thumb to be adjustable in the longitudinal direction to match different thumb lengths and adjustable to different lateral positions to match different thumb positions.

2. The device as claimed in claim 1, comprising five motors for actuating five finger assemblies respectively.

3. The device as claimed in claim 1, wherein each finger assembly has a proximal end portion having at least one threaded opening and two opposite lateral sides, each proximal end portion being formed with a plurality of longitudinally spaced recesses selectively engageable with a plurality of longitudinally spaced protrusions formed on an inner surface of the external platform, and wherein at least one set screw is adapted to pass through at least one longitudinally elongated opening formed on the external platform and is releasably driven into the at least one threaded opening of the proximal end portion abutting against the inner surface of the external platform, thereby allowing each finger assembly to be adjustable in the longitudinal direction to match different finger lengths.

4. The device as claimed in claim 1, wherein the inturned thumb platform has three laterally spaced and longitudinally elongated openings, and the finger assembly for the thumb is adjustable to three different lateral positions.

5. The device as claimed in claim 1, further comprising a side fixation bracket adjustably connected to a little finger side of the external platform at different lateral positions to fit different palm sizes.

6. The device as claimed in claim 5, wherein the side fixation bracket has first and second portions disposed perpendicular to each other, the first portion having a plurality of transversely spaced openings selectively engageable therein with a plurality of transversely spaced annular protrusions, each having a central threaded opening, formed on an inner surface of the external platform, and wherein at least one set screw is adapted to pass through a washer and is releasably driven into one of the central threaded openings, thereby fastening the side fixation bracket to the external platform.

7. The device as claimed in claim 6, wherein the internal platform is provided with at least one opening with a notch defining a catch for releasably holding the internal platform between the washer and the annular protrusions on the external platform.

8. The device as claimed in claim 7, wherein the internal platform has two lateral sides, one lateral side being provided with two indentations and the other lateral side being provided with two other indentations, and wherein two sets of screw and nut are adapted to be driven through two openings formed on the inturned thumb platform and into the two indentations on the one lateral side of the internal platform respectively, and another two sets of screw and nut are adapted to be driven through two openings formed on the second portion of the side fixation bracket and into the two other indentations on the other lateral side of the internal platform respectively.

9. The device as claimed in claim 1, wherein the motors are disposed substantially parallel and in close proximity to the external platform, thereby minimizing a mechanical stress exerted transversely on the device by the motors.

10. The device as claimed in claim 1, wherein the plurality of motors is a linear actuator.

11. The device as claimed in claim 1, further comprising a forearm support having a front end portion and a rear end portion, a mounting insert being detachably mounted on a top side of the front end portion, whereby the palm brace and finger assemblies are mountable on the mounting insert.

12. The device as claimed in claim 11, comprising two interchangeable mounting inserts with two differently oriented mounting portions for mounting thereon the palm brace and finger assemblies for the left and right hands respectively.

13. The device as claimed in claim 11, wherein the forearm support has an upper slanted surface inclining downwardly from the top side to the rear end portion of the forearm support at an angle of about 25 degrees with respect to a horizontal surface on which the forearm support is rested.

14. The device as claimed in claim 11, further comprising a built-in optical device disposed inside the forearm support for positional feedback.

15. The device as claimed in claim 11, wherein the external platform of the palm brace is mounted on the forearm support at an angle of about 10 degrees with respect to a central longitudinal axis of the forearm support.

16. The device as claimed in claim 1, further comprising two electrodes adapted to be adhered on a flexor digitorum muscle and an extensor digitorum muscle respectively for detecting electromyography signals from a user, and a reference electrode adapted to be mounted over a bony prominence of an elbow for providing a common reference to the inputs of the two electrodes.

17. The device as claimed in claim 16, wherein the reference electrode is incorporated into an adjustable strap to facilitate the fixation of the reference electrode on the elbow.

18. The device as claimed in claim 11, further comprising a programmable control unit installed in the forearm support and controlled by a computer platform, wherein the computer platform is selected from the group consisting of Apple IOS, Android, Microsoft Windows, Mac OSX, Linux and Unix.

* * * * *